United States Patent [19]

Rumpp

[11] 4,381,579

[45] May 3, 1983

[54] HANDLE FOR A HAND-HELD DEVICE

[75] Inventor: Gerhard Rumpp, Inning, Fed. Rep. of Germany

[73] Assignee: Hilti Aktiengesellschaft, Schaan, Liechtenstein

[21] Appl. No.: 215,650

[22] Filed: Dec. 12, 1980

[30] Foreign Application Priority Data

Dec. 21, 1979 [DE] Fed. Rep. of Germany ..... 2951886

[51] Int. Cl.[3] ..... B25G 1/10

[52] U.S. Cl. ..... 16/111 R; 16/116 R; 16/DIG. 12; 74/551.9; 81/177 R; 145/61 M; 173/162 H; D8/107

[58] Field of Search ..... 16/110 R, 111 R, 111 A, 16/112, 116 R, DIG. 12, DIG. 15, DIG. 19, DIG. 24, DIG. 25, DIG. 41; 74/551.9; 173/162 H, 170; 145/61 C, 61 K, 61 M; 81/177 R; D8/67, 107

[56] References Cited

U.S. PATENT DOCUMENTS

| | | | |
|---|---|---|---|
| 1,637,120 | 7/1927 | Larson | 16/DIG. 12 |
| 2,531,800 | 11/1958 | Anderson | 173/162 H |
| 3,344,684 | 10/1967 | Steere, Jr. et al. | 74/551.9 |
| 3,915,782 | 10/1975 | Davis et al. | 16/100 R X |

FOREIGN PATENT DOCUMENTS

| | | | |
|---|---|---|---|
| 806479 | 4/1951 | Fed. Rep. of Germany | 16/DIG. 12 |
| 171887 | 12/1921 | United Kingdom | 16/DIG. 12 |
| 592659 | 2/1978 | U.S.S.R. | 74/551.9 |

OTHER PUBLICATIONS

Bohrhammer BBH 320 (funkenstört nach VDE) BAIER.

*Primary Examiner*—Howard N. Goldberg
*Assistant Examiner*—Fred A. Silverberg
*Attorney, Agent, or Firm*—Toren, McGeady and Stanger

[57] ABSTRACT

A handle for a hand-held device such as a hammer drill, includes an axially elongated tubular support member formed of a wear-resistant material and a grip member laterally encircling at least a portion of the outer surface of the support member. The grip member is fitted into a recess in the outer surface of the support member. Radially outwardly extending flange-like projections on the support member form the opposite ends of the recesses and project radially outwardly from the outer surface of the grip member for protecting it against wear.

2 Claims, 2 Drawing Figures

HANDLE FOR A HAND-HELD DEVICE

SUMMARY OF THE INVENTION

The present invention is directed to a handle particularly for use on a hand-held device such as a drilling machine.

As a rule, hand-held devices have at least one handle which the operator uses to guide the device toward a workpiece. In a hand-held drilling machine, in addition to a spade handle, a side handle is frequently provided.

While guiding a hand-held tool, the hand holding the handle of the device is often subjected to high percussion loads over a long period of use. Extreme loads are known to occur in hammer drills which, due to the percussive force imparted to the tool also applies percussive force to the device itself. To prevent such percussive forces from causing injuries, such as blisters on the hand of the operator, it has been known to provide an elastically resilient handle.

In known side handles for a hand-held device, a metallic tubular support member is enclosed by a sleeve-like cover of rubber. The cover is slid over the support member and has radially extending ribs on the cover surface so that the ribs, in addition to the elasticity resulting from the rubber used in forming the cover, also facilitate an adaptation of the handle to the hand of the operator. Furthermore, it has been attempted by the design of such a grip in hammer drills to eliminate the transmission of the percussive force acting in the device to the operator.

Such hand-held devices are usually subjected to rather rough treatment, for example, in the case of drilling machines used on a construction site they are often placed on rough surfaces, such as concrete floors, and the handles are subjected to considerable wear, at least at projecting end portions and, as a result, require early replacement of the entire handle or at least of the resilient cover.

To limit the extent of wear as much as possible, known covers have been made of relatively hard rubber which has a high resistance to wear, however, with such covers the palm of the hand of the operator is not well protected and the percussive force is only damped to a small degree.

Therefore, it is the primary object of the present invention to provide a handle which is distinguished by a high mechanical strength along with a soft damping holding surface.

In accordance with the present invention, the handle is constructed of a support member of mechanically wear-resistant material and an enclosing grip member of a soft-elastic material which is capable of affording a strong damping effect.

Accordingly, the support member can be constructed as a tubular member made of steel or a wear-resistant, hard plastics material. The selection of the material for the grip cover on the tubular support member can be made basically in accordance with the requirement for a high damping efficiency and soft, elastic materials, are particularly suitable. If a soft material is used, it is unnecessary to provide a special shape for affording the damping effect such as forming ribs in the resilient cover.

Preferably, the grip member is sleeve-like and is fitted onto the support member so that parts of the support member project outwardly beyond the grip member, particularly at the projecting end portion of the handle.

In this way, the mechanically stressed or endangered zone on the handle is formed by the wear-resistant support member.

To provide effective protection of the grip member, preferably the grip member is located in a recess formed on the support member so that parts of the support member project radially outwardly from the grip member. Accordingly, the projecting portions of the support member hold the grip member against axial displacement and at the same time protect its surface from wear.

To facilitate the replacement of the grip member which because of its simple design and low cost can be produced as an expendable part, the grip member is releasably attached to the support member. A particularly simple arrangement for replaceability is afforded when the grip member is fastened to the support member by a snap-on connection.

It is possible and in some instances advantageous to fix the grip member on the support member, for example, by vulcanization, however, it is particularly advantageous in devices which are subjected to substantial wear during use to form the grip member as a replaceable jacket which encircles at part of the support member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
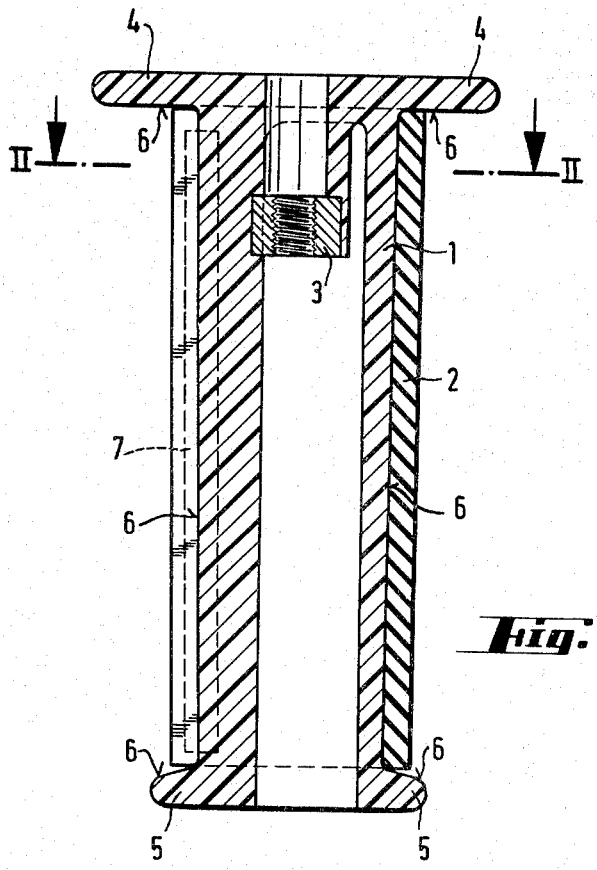
FIG. 1 is an axially extending sectional view of a side handle taken along line I—I of FIG. 2.
Figure 2:
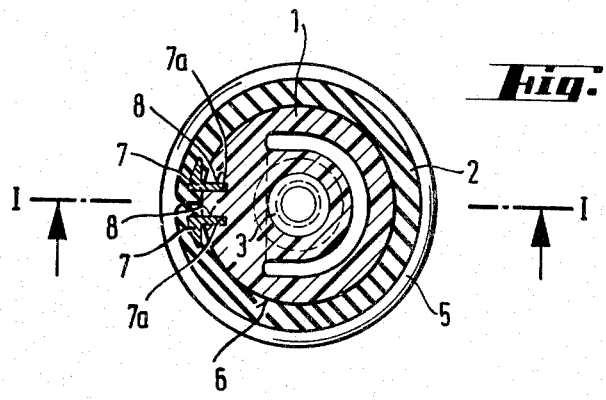
FIG. 2 is a sectional view of the side handle shown in FIG. 1 taken along the line II—II.

In FIG. 1 the side handle consists of a tubular support member 1 formed of a mechanically wear-resistant plastics material laterally enclosed for most of its axial length by a grip member in the form of a soft-elastic rubber jacket 2. A threaded insert 3 is positioned within the support member 1 for fixing the handle on a stub located on a hand-held device, not shown in the drawing.

As viewed in FIG. 1, the upper end of the support member fits against the hand-held device while the lower end projects outwardly from it. At the upper end, the support member 1 has a radially projecting support ring or flange 4. At the opposite or lower end, another flange-like projection 5 is provided, however, it does not project outwardly from the support member to the extent that the ring 4 does. The support ring 4 and the flange-like projection 5 define the opposite ends of a recess 6 extending circumferentially around the support member 1. Jacket 2 is fitted around the support member 1 within the recess 6. The support ring 4 and the flange-like projection 5 prevent any axial displacement of the jacket 2 along the support member 1. The flange-like projection 5 has, as its primary purpose, the protection of the jacket 2 from mechanical damage so that when the device is placed on a support surface the handle will rest on the flange-like projection 5 and not on the surface of the jacket 2.

To fasten the jacket 2 on the support member 1, snap wedges 7 are anchored by a molding technique in the region of the abutting edges of the jacket 2 which edges extend in parallel relation in the axial direction of the handle. Each of the snap wedges 7 includes a web 7*a* fitted into a recess 8 in the support member with the web extending outwardly from the support member. The locking action provided between the snap wedges 7 and webs 7*a* and the recess 8 releasably secure the jacket 2 on the support member 1.

While specific embodiments of the invention have been shown and described in detail to illustrate the application of the inventive principles, it will be understood that the invention may be embodied otherwise without departing from such principles.

What is claimed is:

1. Handle for use on a hand-held device, such as a hammer drill, comprising an axially elongated support member arranged to be secured to the hand-held device, said support being formed of a wear-resistant material, an axially extending grip member laterally enclosing at least an axially extending portion of the outer surface of said support member, said grip member being formed of a soft-elastic material forming a gripping surface and providing a damping effect for forces transmitted to the handle from the hand-held device, means formed on and extending radially outwardly from the outer surface of said support member and providing a recess formed in the other surface of the support member with the recess extending circumferentially around and in the axial direction of the support member, said grip member positioned within said recess, and said means projecting radially outwardly beyond the outer surface of said grip member at the opposite ends of said recess, wherein said support member comprising a tubular member, and said means formed on the outer surface of said support member comprising a pair of radially outwardly extending flange-like projections spaced apart in the axial direction of and formed integrally with said support member with radially outer surface of said projections located radially outwardly from the outer surface of said grip member, including means for releasably securing said grip member on said support member, said grip member comprises a sleeve-like member slit in the axial direction thereof from one end to the other, said means for releasably attaching said grip member to said support member comprising a wedge member fitted in said grip member on each side of an extending in the axial direction along the slit, and a web formed on each said wedge member and fitted into a recess in said support member extending therealong in the axial direction thereof, said web of each said wedge member engageable with said support member for securing said grip member on said support member.

2. Handle, as set forth in claim 1, wherein said grip member having one said wedge member and said web engageable within one said recess in said support member and then wrapped around said support member with the other said wedge member and said web engageable with the other said recess in said support member releasably securing said grip member on said support member.

* * * * *